US006435934B1

(12) United States Patent
Bender

(10) Patent No.: US 6,435,934 B1
(45) Date of Patent: Aug. 20, 2002

(54) DEVICE FOR DISPLAYING A CHARACTER HAVING A VIRTUAL IMAGE

(76) Inventor: Lynda Gail Bender, 1360 Crows Foot Rd., Baltimore, MD (US) 21104

( * ) Notice: Subject to any disclaimer, the term of this patent is extended or adjusted under 35 U.S.C. 154(b) by 109 days.

(21) Appl. No.: 09/597,246

(22) Filed: Jun. 20, 2000

(51) Int. Cl.[7] ..... A63H 33/22

(52) U.S. Cl. ..... 446/219; 446/268; 446/395; 40/219; 40/427; 40/900

(58) Field of Search ..... 446/219, 321, 446/391, 268, 395; 359/855, 856, 858, 861; 40/219, 427, 900

(56) References Cited

U.S. PATENT DOCUMENTS

| | | | | | |
|---|---|---|---|---|---|
| 885,669 | A | | 4/1908 | Delloye et al. | |
| 936,344 | A | * | 10/1909 | Myers | 446/217 |
| 950,938 | A | * | 3/1910 | Myers | 446/217 |
| 1,260,133 | A | | 3/1918 | Birdsall | |
| 1,388,789 | A | | 8/1921 | Anderson | |
| 2,499,483 | A | | 3/1950 | Foy | |
| 2,628,533 | A | | 2/1953 | Oetjen | |
| 3,647,284 | A | | 3/1972 | Elings et al. | |
| 3,729,865 | A | | 5/1973 | Naunheim | |
| 4,006,555 | A | | 2/1977 | England et al. | |
| 4,026,066 | A | | 5/1977 | Reiner et al. | |
| 4,156,975 | A | * | 6/1979 | Harding | 40/427 |
| 4,157,633 | A | | 6/1979 | Reiner et al. | |
| 4,192,580 | A | * | 3/1980 | Meyer | 359/801 |
| 4,261,657 | A | | 4/1981 | Reiback | |
| 4,294,515 | A | | 10/1981 | Kaufman | |
| 4,438,579 | A | | 3/1984 | Engel | |
| 4,522,604 | A | | 6/1985 | Stubbmann | |
| 4,623,223 | A | | 11/1986 | Kempf | |
| 4,671,625 | A | | 6/1987 | Noble | |
| 4,802,750 | A | | 2/1989 | Welck | |
| 5,066,078 | A | | 11/1991 | Wurst | |
| 5,139,455 | A | * | 8/1992 | Israel | 434/371 |
| 5,311,357 | A | | 5/1994 | Summer et al. | |
| 5,392,161 | A | * | 2/1995 | Weder et al. | 359/861 |
| 5,439,407 | A | * | 8/1995 | Friedel | 362/806 |
| 5,451,181 | A | * | 9/1995 | Denoux | 40/454 |
| D383,061 | S | | 9/1997 | Kolby-Larsen | |
| 5,743,038 | A | | 4/1998 | Soto | |
| 5,800,236 | A | * | 9/1998 | Joun | 446/219 |
| 5,810,162 | A | | 9/1998 | Au et al. | |
| 5,864,973 | A | | 2/1999 | Cole | |
| 6,135,599 | A | * | 10/2000 | Fang | 353/28 |

FOREIGN PATENT DOCUMENTS

| | | | | |
|---|---|---|---|---|
| JP | 08-029690 | * | 2/1996 | 359/858 |
| JP | 10-239635 | * | 9/1998 | 446/219 |
| JP | 10-297643 | * | 11/1998 | 446/219 |
| JP | 11-219144 | * | 8/1999 | 359/858 |
| JP | 11-281917 | * | 10/1999 | 359/858 |

* cited by examiner

*Primary Examiner*—Jacob K. Ackun
*Assistant Examiner*—Urszula M Cegielnik
(74) *Attorney, Agent, or Firm*—Diederiks & Whitelaw, PLC

(57) ABSTRACT

A device for displaying a character having a virtual image wherein the display device includes an outer housing and an optical assembly. In one embodiment, the outer housing provides a surface for depicting a character. The optical assembly includes a first concave mirror and a second concave mirror facing the first concave mirror with one of the mirrors being provided with an aperture aligned with a hole in the outer housing and the other mirror supporting an object related to the character. With this construction, an image projected from the object will appear to float above the character in an attractive fashion. In one preferred embodiment of the invention, the outer housing takes the form of a doll. In yet other embodiments, the outer housing is in the form of a box used for shipping or a box used to hold jewelry, candy, or memorabilia, etc.

11 Claims, 4 Drawing Sheets

111
112
95
86
90
20
81
80
113
114

95
100
25
105

20
95
25
42
35
36
73
72
44
45
76
32
56
75
64
54
62

DEVICE FOR DISPLAYING A CHARACTER HAVING A VIRTUAL IMAGE

BACKGROUND OF THE INVENTION

1. Field of the Invention

The present invention relates to display devices and, more particularly, to display devices that incorporate both some type of character and an optical assembly which can project a virtual image. The display device may be incorporated into various outer housings such as dolls, jewelry boxes or any type of box or package used to ship items.

2. Description of the Prior Art

In today's market it is becoming increasingly important to provide products which are aesthetically pleasing in addition to having useful functions. Consumers are becoming more and more demanding and desirous of packaging and products that will not only look good in a storefront but serve some additional purpose as either a display or novelty item. Towards that end, many manufacturers have placed either attractive designs on the outside of the boxes they ship their products in, or alternatively, have used various types of characters in order to induce people to purchase their products. Sometimes these characters are either depicted as an image on a box or occasionally sold on their own as a three-dimensional figure or doll.

Occasionally a purchaser may see such a character either depicted as an image on a package or as a full three-dimensional figure and may wonder what the character is thinking. Some solutions previously proposed have included providing a little "balloon" near the character which indicates what the character is either saying or thinking. Alternatively, a figure may be sold with an attached little booklet so that a consumer might read about what the character is thinking and, in general, what the personality traits of the character are.

With regard to the problem of making packaging or boxes aesthetically pleasing, it is already known in the art to form a box, such as a jewelry box, in a heart shape. For example, see U.S. Pat. No. 5,810,162 which shows in FIG. 2 a heart shaped jewelry box 10. This patent, however, fails to recognize the advantage of using characters to make the package more aesthetically pleasing, let alone the advantage of letting people know what those characters are thinking.

With regard to using a three-dimensional character on its own, U.S. Pat. No. 4,522,604 discloses a rockable toy with a reflecting mirror. Essentially the mirror is positioned so that when a child looks in the mirror it will see a moving head of a figure. The mirror is not used to indicate or represent what the doll or toy is thinking but rather merely to entertain a child who may be playing with the toy.

U.S. Pat. No. 3,729,865, which is incorporated herein by reference, discloses a doll with a mirrored face and a storage compartment. Specifically the patent discloses that "portions of the appendages can be modified in a manner to provide storage compartments for elongated objects such as nail files, combs, knitting needles and the like. When so modified, the subject matter of the invention serves a dual function: 1) as a doll and 2) as a purse, clutch bag or overnight case." The patent also recognizes the desirability of using a convex or otherwise modified mirror to provide novel and amusing reflective effects. However, while this patent does recognize using a mirror with a doll, it does not use a mirror to convey what the doll is thinking," nor does it use a mirror or a combination of mirrors in any specialized way to convey such information.

Finally, U.S. Pat. No. 3,647,284, which is hereby incorporated by reference, discloses a mirror arrangement designed to display objects such as jewelry. While this patent does use an interesting combination of mirrors to provide a display device, the display is generally designed to display jewelry while avoiding theft, rather than to provide for transportation of the jewelry. Furthermore, nowhere does the patent appear to disclose using characters in an aesthetic way.

As can be seen from the above discussion, while it is known and considered desirable to use characters to sell products or to sell characters themselves, and in addition, to have consumers be able to tell what those characters are thinking, none of the proposed solutions in the prior art have achieved these objectives.

Based on the above, there exists a need in the art for a combination of a character representation and an optical assembly which will be able to display a virtual image of what the character is thinking or to provide an image of its spirit or soul. More particularly, there exists a need in the art for a character represented by a doll that incorporates an optical assembly to display an image related to the doll's character. Furthermore, there exists a need in the art for a character depicted on a package, such as a candy or a jewelry box, that also includes an optical assembly to display an image related to the character.

SUMMARY OF THE INVENTION

It is the main object of this invention to provide a character that is constructed in combination with an optical assembly which will provide a holographic, three dimensional virtual image floating around the character. The image allows the viewer to see the character's soul or spirit to see whatever is on his/her mind.

It is another object of this invention to incorporate such a character and corresponding optical assembly within an outer housing such as a doll so that the optical assembly will project an image over the doll.

It is another object of this invention to provide a packaging or outer housing, such as a jewelry box or a candy box, wherein a character is displayed on the lid of the box and an optical assembly is provided to project a three dimensional image above the character.

Accordingly, the present invention provides for a display device for displaying a character having a virtual image wherein the display device comprises an outer housing having a hole formed therein, the outer housing being used to depict a character and an optical assembly including a first concave mirror, a second concave mirror facing the first concave mirror, one of the mirrors being provided with an aperture aligned with a hole in the outer housing and the other mirror supporting an object representative of what the character is thinking. With this construction, the object will appear to float above the character in an attractive fashion.

For example, in one preferred embodiment of the invention, the outer housing is in the form of a doll. The optical assembly actually makes up the major structural component of the doll's head and body and the aperture in the optical assembly is aligned with the doll's mouth. Additionally appendages such as legs and arms are attached to the doll's torso. Optionally, the arms and legs may be attached using a wire frame type construction. Finally, the doll may be dressed as dolls are typically dressed to give the desired aesthetic appearance.

In another embodiment of the invention, the outer housing is in the form of a box such as that used to ship candies.

Preferably the box exhibits a heart shaped construction and the optical assembly is mounted therein. A lid with a hole is also provided over the box and, when used to close the box, the hole in the lid is aligned with an aperture in the optical assembly. A depiction of a character is provided on top of the lid so that the hole is strategically placed within the character in order to enable the optical assembly to produce an image indicative of what the character is thinking or representative of its soul or spirit.

In yet another embodiment of the invention, the outer housing may be in the form of a box having numerous drawers or storage compartments for various small items such as jewelry. The top of the jewelry box may support a depiction of a character and also have a hole located therein. The optical assembly will be mounted just below the top surface of the jewelry box so as to be able to project an image above the character.

Additional objects, features and advantages of the present invention will be more readily apparent from the following description of the preferred embodiments thereof, when taken in connection with the drawings wherein like reference numerals refer to corresponding parts in the several views.

DETAILED DESCRIPTION OF THE PREFERRED EMBODIMENTS

Figure 1:
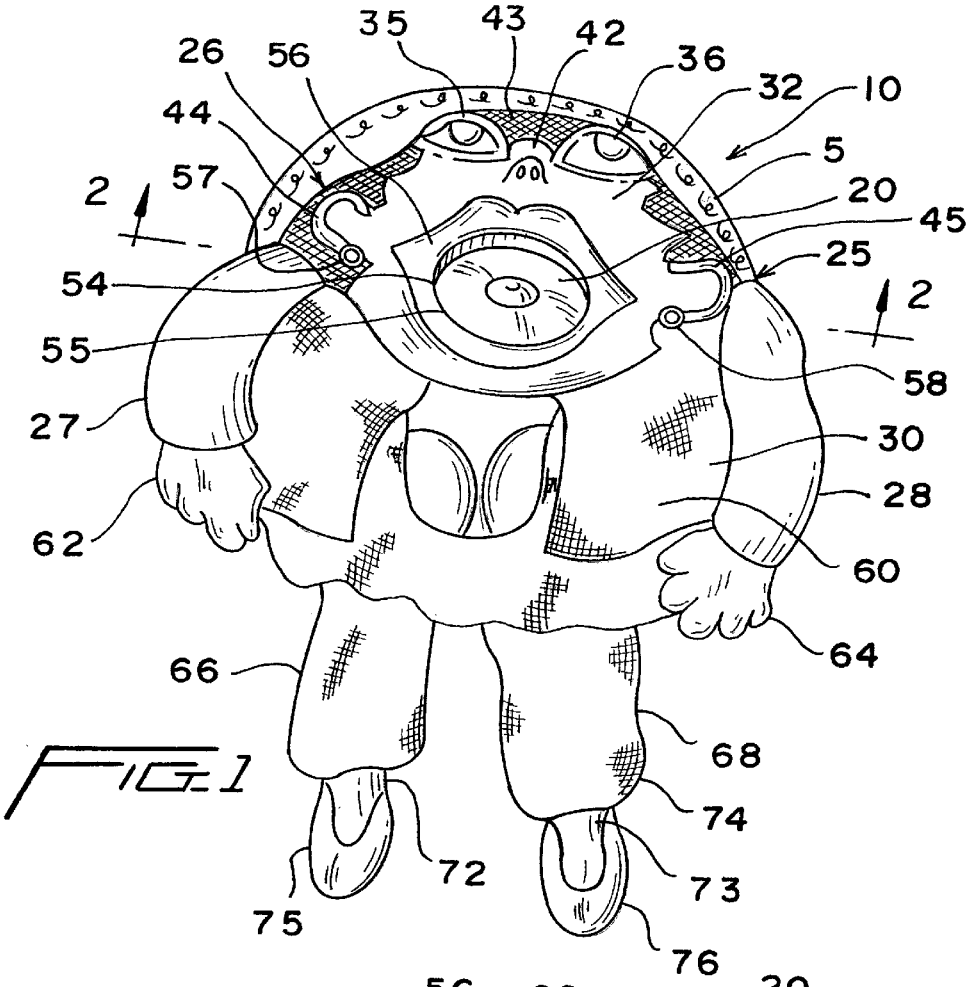
FIG. 1 is a perspective view of a display device incorporating both an outer housing in the form of a doll and, in addition, an optical assembly according to a first preferred embodiment of the present invention.

With initial reference to FIG. 1 of the drawings, a display device having an outer housing 5 in the form of a doll is generally indicated at 10 in accordance with a first preferred embodiment of the present invention. Inside the doll 10 is shown an optical assembly 20. The doll 10, illustrated here as a belly dancer, is provided with a body 25, comprised of a torso 30 and a head 26. The head 26 is shown at the top of FIG. 1 and includes a face 32 having eyes 35, 36, a nose 42, hair 43 and ears 44 and 45. Also provided is a mouth 54, which is formed essentially by a circular hole 55 so that the optical assembly 20 can be seen therethrough. Each of the features of the doll's face 32 may be made from conventional materials. Additionally, each feature may be painted or colored with different pigments as desired. Such materials and techniques are well known in the art of doll making and will not be repeated here. As an example, the doll's hair 43 might be painted black and lips 56 red while its ears 44, 45 may be adorned with ear rings 57, 58.

A critical feature as far as this invention goes in regards to the doll 10 is that, as mentioned above, a hole 55 be formed in order to allow someone to see an image created by the optical assembly 20 located therein. Preferably, the hole 55 is the doll's mouth 54 and the optical assembly 20 is set up to display an image representing what the doll 10 is thinking. The doll's torso 30, arms 27, 28, and legs 66, 68 can be made with the usual fabric over stuffing construction found in many dolls. Additionally, various clothing 60 may be put on the doll 10 and those shown here are merely typical examples. Arms 27, 28 may be attached to the torso 30 and, respectively, hands 62 and 64 may be attached to the arms 27, 28. Once again, these appendages may be adorned as necessary. For example, the fingers on each hand 62, 64 could be painted or the doll 10 could be provided with jewelry. Finally, the doll's legs 66 and 68 are also attached to the torso 30 and the respective feet 72 and 73 are attached thereto. The doll 10 may also be provided with additional clothing such as trousers 74 and shoes 75, 76. Once again, it should be noted that numerous different types of clothing can be placed on the doll 10 without generally drifting from the scope of the invention.

Figure 2:
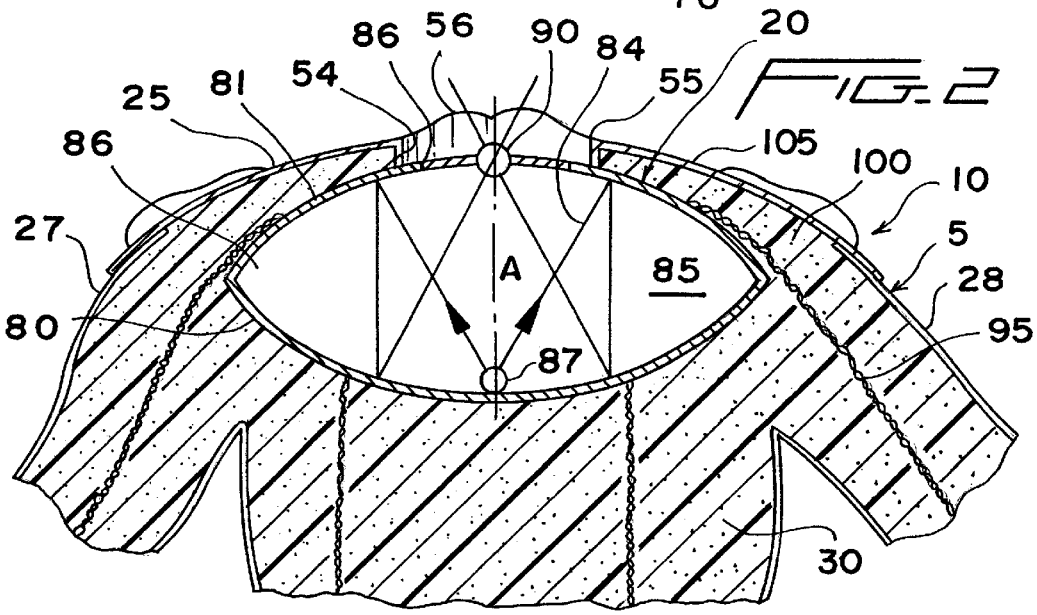
FIG. 2 is a cross-sectional view along the lines 2—2 in FIG. 1 of the display device of the first preferred embodiment according to the present invention.

Turning now to FIG. 2 there is shown a cross sectional view of the doll 10 of FIG. 1 taken along the lines 2—2. The optical assembly 20 can clearly be seen within the torso 30 of the doll 10. The optical assembly 20 is constructed from a pair of concave mirrors, 80 and 81. A first concave mirror 80 having a first reflecting surface is formed as a surface revolution around an optical axis "A". A second concave mirror 81 having a second reflecting surface is also formed as a surface of revolution around optical axis "A". This second concave mirror 81 faces the first concave mirror 80 and is preferably attached thereto at its outer periphery thus forming an internal cavity 85. While the first concave mirror 80 has a continuous reflective surface the second concave mirror 81 is formed with an aperture 86 at its center. Disposed near the reflective surface of the first concave mirror 80 at a first location within the internal cavity 85 there is an object 87 shown as a circle in FIG. 2. In operation, light rays 84 will emanate from the object 87 generally along the lines indicated in FIG. 2. These light rays 84 will reflect off of the second mirror 81 and back towards the first mirror 80 and finally converge at a second location where an image 90 is formed in the aperture 86 or just above the aperture 86 of the mirror 81 for viewing. The result is that an image 90 is formed from the object 87 and it appears to float above the doll 10. Ideally, the object 87 is some type of item, which will represent the thoughts or feelings of the doll 10. For example, using candy or food may indicate that the doll 10 is hungry, although numerous different objects 87 may be used and still be within the scope of this invention. The object 87 must only be related in some way to the character. It need not necessarily be representative of the characters thoughts or feelings. The actual location of the object 87 can also be adjusted which will result in a change of the location of the image 90. The details of optics in such a display assembly can be found in U.S. Pat. No. 3,647,284, which is hereby incorporated by reference.

Figure 3:
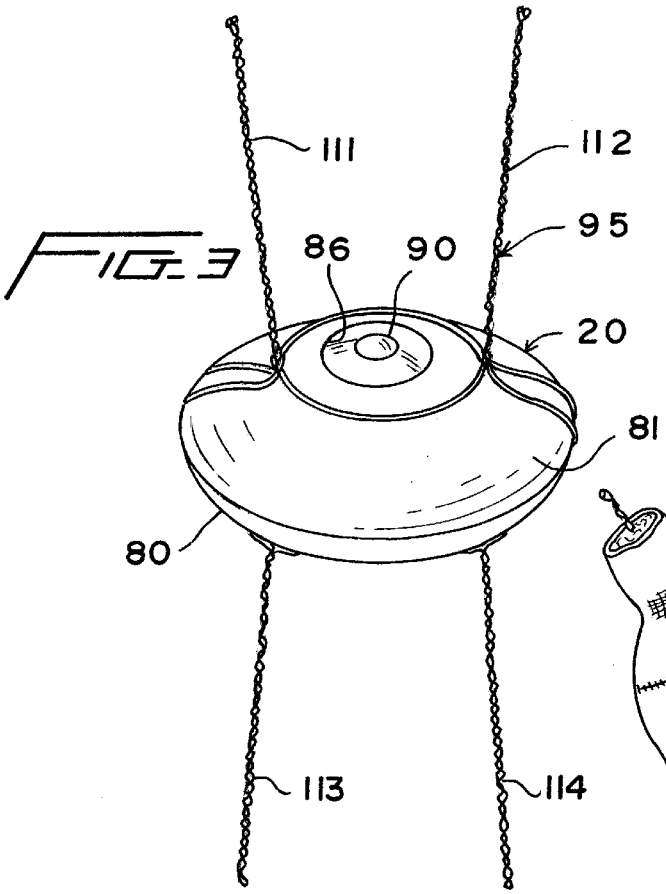
FIG. 3 is a perspective view of the optical assembly and an attached wire frame showing the first steps in constructing the display device according to the first embodiment of the invention.
Figure 4:
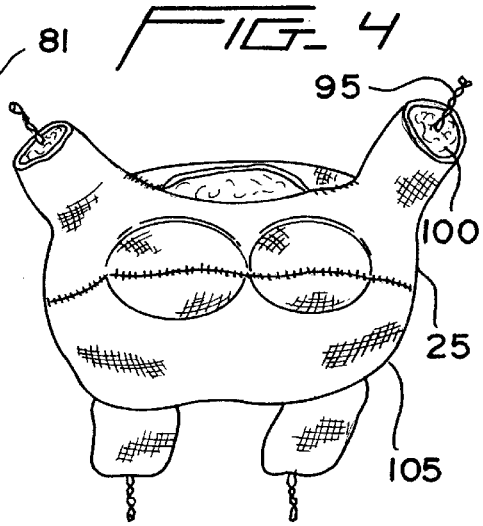
FIG. 4 is a perspective view of the display device being constructed according to the first preferred embodiment of the invention.
Figure 5:
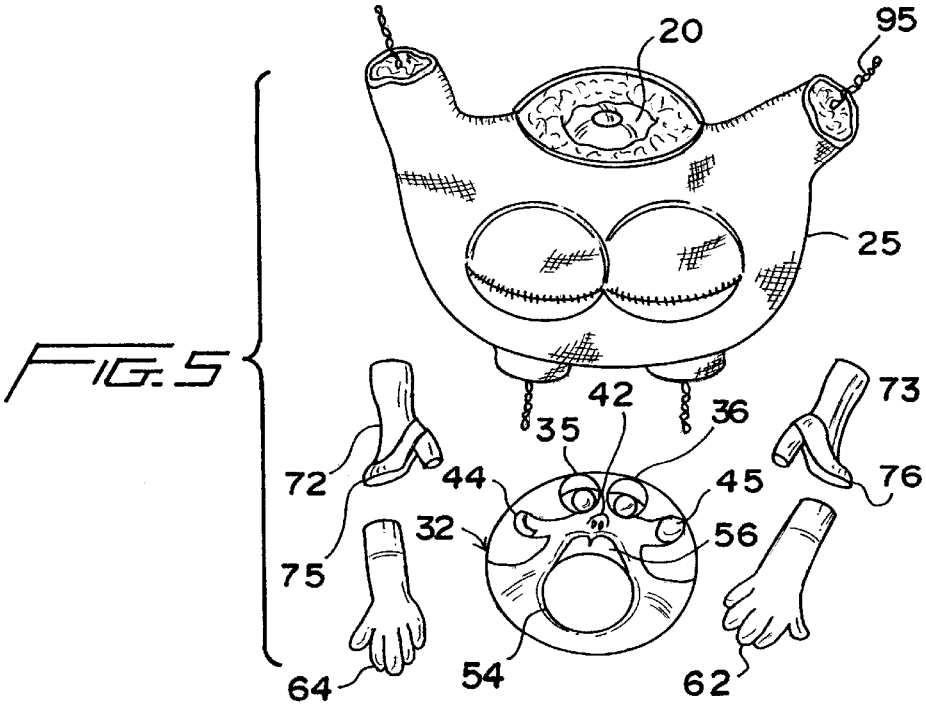
FIG. 5 is a perspective view of various pre-assembled parts of the display device according to the first preferred embodiment of the invention.

Mounted to the optical assembly 20 as shown in FIGS. 3–5 there is a wire frame 95. The wire frame 95 allows the doll 10 to be placed and stay in any of various possible positions such as moving the arms 27, 28 outwardly or bending the legs 66, 68. However, these wires are not necessary and the doll 10 could simply be made of stuffing 100 with a covering 105 and still fall within the scope of this invention.

Construction of the invention and more particularly of the preferred embodiment of a doll 10 begins with an optical assembly 20. Such an assembly 20 may be purchased from a manufacturer such as the one ALPI International distributes under the name "Magic Levitation Chamber". Such an optical assembly 20 can be seen clearly in FIGS. 2 and 3. Initially, an object 87 is placed at a first location near the center of the mirror 80 without an aperture, and then the two mirrors 80, 81 are preferably permanently sealed together at their mating outer periphery with glue. With this configuration, a three-dimensional reflection image 90 appears to hover at a second location over the aperture 86 in the optical assembly 20. By gluing the two halves 80, 81 of the optical assembly together, this creates a major structural element for the doll 10 which eventually becomes the base for the doll's head 26 and torso 30.

In order to make the doll 10 into a posable figure, the wire frame structure 95 is added to the optical assembly 20 as shown in FIG. 3. The wire frame 95 has four strips 111, 112, 113, 114 extending into four different directions. Two of these strips 111, 112 support the doll's arms 27, 28 while two of the strips 113, 114 support the doll's legs 66, 68. The wire is somewhat flexible and can be bent to a desired shape to eventually allow the doll 10 to be posable in any desired configuration. As shown in FIG. 4 after the wire frame 95 is attached to the optical assembly 20, stuffing 100 and a covering 105 may be placed over the optical assembly 20 and wire frame 95 to form the outer housing 105 and to shape the body 25 to desired portions. The non-posable figures would be similar except they do not contain the wire frame 95, rather the optical assembly is 20 is just covered with a fabric 105 and then stuffed 100 and finally the covering 105 is stitched in place. Alternatively, the doll could be constructed of other materials, such as plastic or vinyl. In any event, a hole 55 is left open for the image 90 to be seen clearly outside the doll 10. Finally, the various arms 27, 28, legs 66, 68, hands 62, 64 and feet 72, 73 along with the head 26 are formed to a desired shape, decorated accordingly, then attached to the body 25 of the doll 10 in their appropriate spots.

Once the doll 10 is fully manufactured, it can then be costumed with various types of clothing 60. For example, clothing 60 could be provided for a bridal doll, a slumber party doll and a diva doll. The clothing 60 and the object 87 located within the optical assembly 20 would correlate with the general theme of each doll 10. It should be noted that dolls need not be characters that are human but could also be animals, for example, a dog. Once again, a decoration of the doll 10 should correspond to the general theme of that doll 10 as should the image 90 produced by the respective optical assembly 20.

Figure 7:
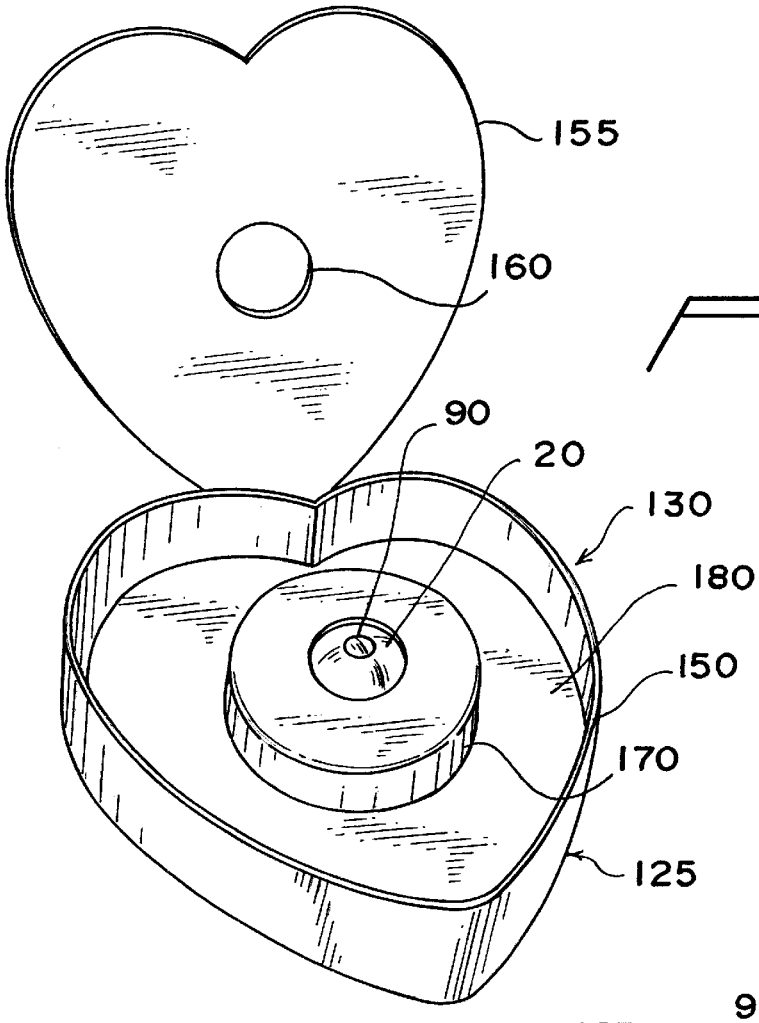
FIG. 7 is a perspective view of the display device in FIG. 6 having been opened according to a second preferred embodiment of the invention.
Figure 6:
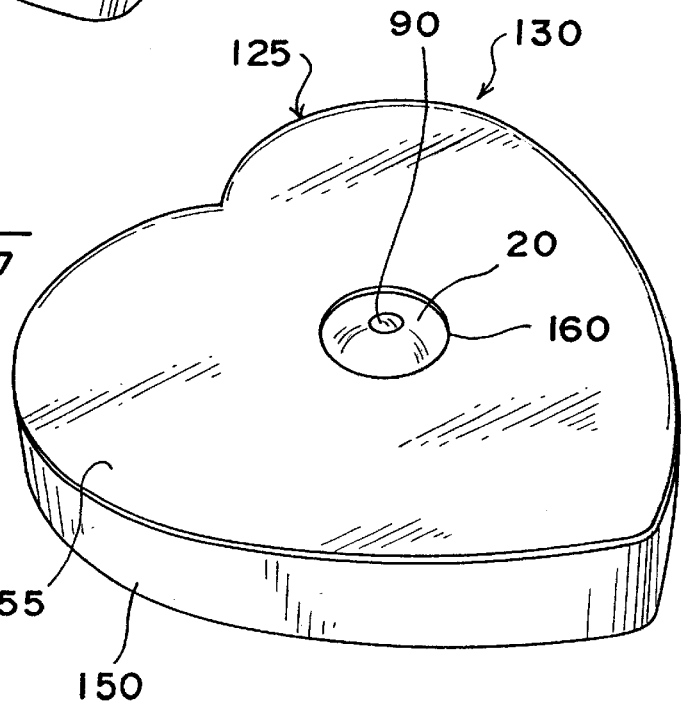
FIG. 6 is a perspective view of the display device wherein the outer housing is in the form of a box incorporating a character according to a second preferred embodiment of the present invention.
Figure 8:
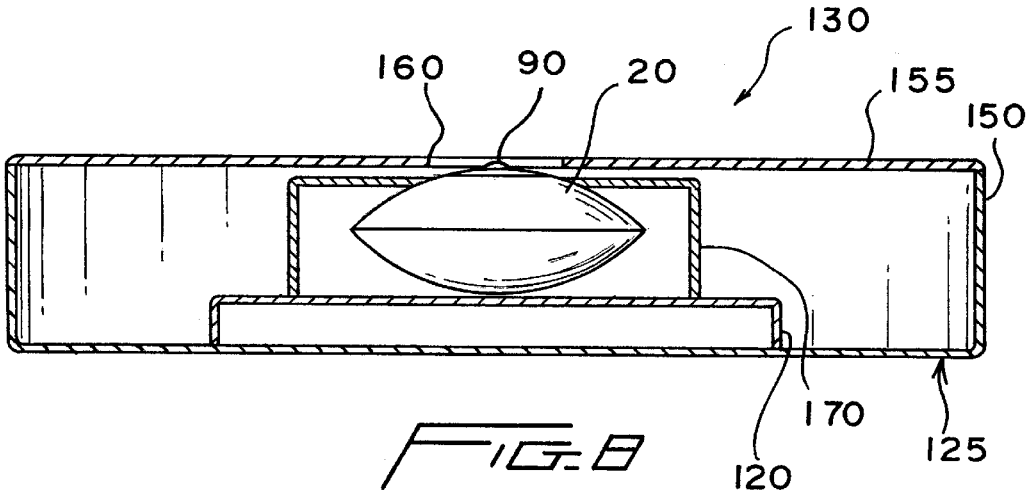
FIG. 8 is a cross sectional view of the display device shown in FIG. 6 taken along the line 8—8.

Referring now to FIGS. 6–8 there is shown a second preferred embodiment of the invention wherein an outer housing 125 is in the form of a box or package 130 incorporating an optical assembly 20. A character is depicted on the cover 155 of the box 130 and the optical assembly 20 provides a floating image 90 of something related to the character. Specifically, FIG. 6 shows a heart shaped base 150 having a corresponding heart shaped cover 155 mounted thereon. The base 150 and cover 155 form an outer housing 125. The cover 155 provides a surface for depicting the character. Preferably, the center of the character's mouth is aligned with a hole 160 formed in the cover 155 and beneath the hole 160 there is disposed the optical assembly 20. As with the previous embodiment, an image 90 is provided and it appears to float above the character. It should be noted that the hole 160 does not necessarily coincide with the mouth of the character. It is only important that the image 90 be related to the character and it need not be located in the character's mouth.

Turning now to FIG. 7, the box 130 having a base 150 and a cover 155 is shown in an open configuration. The optical assembly 20 is mounted within box 130. Again, the image 90 is provided to project through the hole 160 located in the cover 155. Note also a storage area 180 is present to provide room for various items such as candies or jewelry.

Turning now to FIG. 8 there is shown a cut-away view of the box 130 depicted in FIGS. 6 and 7. Here the mounting device 170 is clearly shown supporting the optical assembly 20, holding it in place. Platform 120 may be added as required to adjust for the height of the optical assembly 20. The optical assembly 20 in the second preferred embodiment is identical to the optical assembly 20 of the first preferred embodiment and thus will not be described again.

Figure 9:
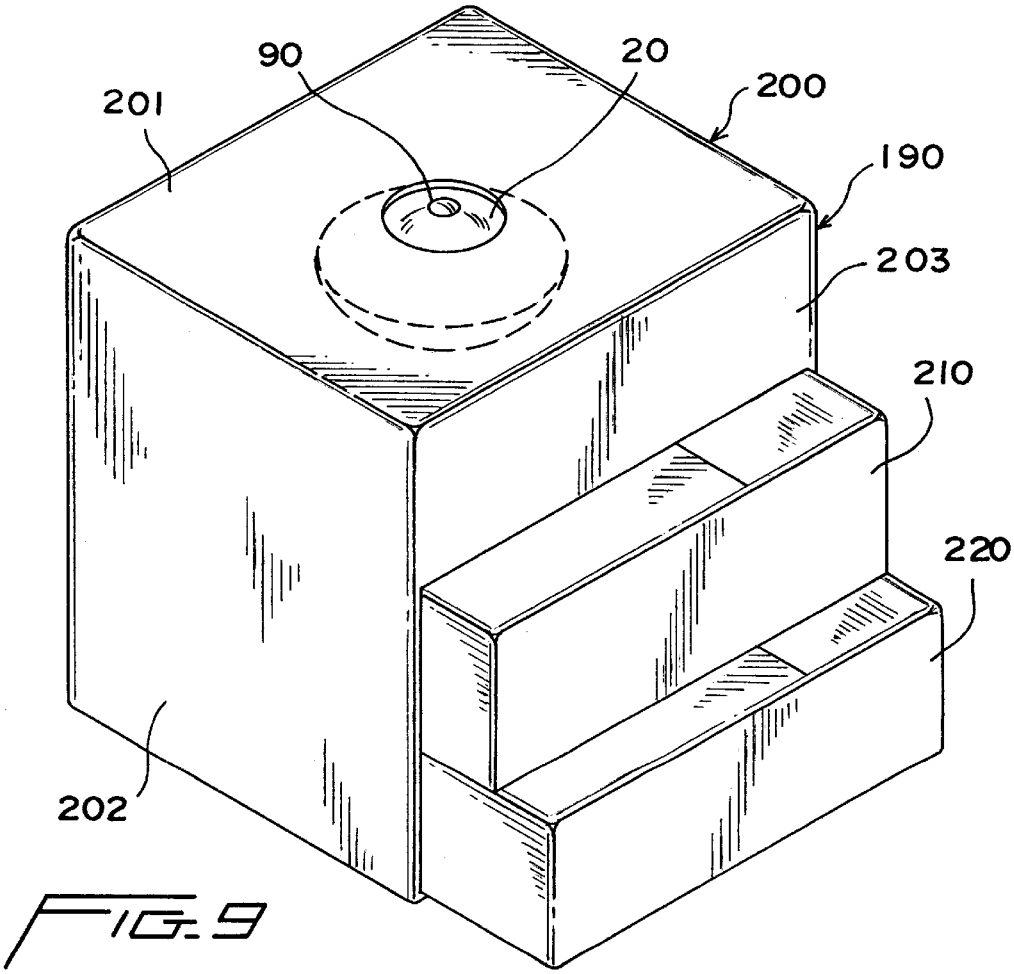
FIG. 9 is a display device wherein the outer housing is in the form of a jewelry box according to a third preferred embodiment of the invention.

Referring now to FIG. 9 there is shown a third preferred embodiment of the invention wherein the optical assembly 20 is mounted within an outer housing 190 or a jewelry box 200. Note that a top 201 of a jewelry box 200 provides a surface wherein a character may be depicted. Once again the center of the character's mouth preferably, but not necessarily, will align with the aperture 86 of the optical assembly 20 shown in hidden lines in FIG. 9. Also, as with the two other preferred embodiments, image 90 represents the character's thoughts or its spirit or soul. The box 200 itself has a side 202, a front 203, which can be clearly seen, along with a second side (not shown) and a back (not shown). It is generally of a rectangular prismatic shape. Two drawers are provided (210, 220) each with a storage area for various items such as jewelry or other small valuables. The optical assembly 20 functions similarly to the first preferred embodiment and will not be described again.

Although described with respect to the preferred embodiment of the invention, it should be understood that various changes and/or modifications can be made to the invention without departing from the spirit thereof. Therefore, the specific embodiments disclosed herein are to be considered illustrative and not restrictive. Instead, the invention is only intended to be limited to the scope of the following claims.

I claim:

1. A display device comprising:

an outer housing, said outer housing having a hole formed therein; and an optical assembly including a first concave mirror having a concave reflective surface and a second concave mirror having a concave reflective surface, said first and second concave mirrors being arranged so that their respective reflecting surfaces face one another with an internal cavity defined therebetween, one of said first and second concave mirrors having an aperture formed therein, said optical assembly being mounted in said housing with said aperture being aligned with said hole, wherein an image of an object positioned at a first location within the internal cavity will be projected to a second location for viewing.

2. The display device according to claim 1 wherein said outer housing depicts a character.

3. The display device according to claim 2 wherein said outer housing comprises a doll having a body including a torso, a head attached to said torso and appendages attached to said torso, said head having a mouth formed therein.

4. The display device according to claim 3 wherein said hole aligns with the mouth of said doll.

5. The display device according to claim 3 wherein said doll includes a wire frame.

6. The display device according to claim 5 wherein the arms and legs of said doll are attached to said frame.

7. The display device according to claim 3 wherein said optical assembly supports the head and torso of the doll.

8. The display device according to claim 2 wherein said outer housing constitutes a box having a top fitted thereon, said hole being formed in said top.

9. The display device according to claim 8 wherein said box is heart shaped.

10. The display device according to claim 8 wherein said box includes a storage area.

11. The display device according to claim 2 wherein said outer housing constitutes a box with several drawers, said box having a top said hole being formed in said top.

* * * * *